US005613922A

United States Patent [19]

Hsiang

[11] Patent Number: 5,613,922

[45] Date of Patent: Mar. 25, 1997

[54] MULTIPURPOSE ATHLETIC TRAINING APPARATUS

[76] Inventor: Hua-Lu Hsiang, No. 520-1, Sec. 2, Hai-Shan Rd.,, Hai-Hun Tsun, Lu-Chu Hsiang, Tao-Yuan Hsien, Taiwan

[21] Appl. No.: 511,857

[22] Filed: Aug. 7, 1995

[51] Int. Cl.[6] ..... A63B 69/00

[52] U.S. Cl. ..... 473/435; 482/28; 482/27; 473/416; 473/492; 108/8

[58] Field of Search ..... 273/26 A, 410, 273/390, 407; 482/26–29; 182/139, 140; 248/133, 137, 139, 141; 269/69, 76, 71

[56] References Cited

U.S. PATENT DOCUMENTS 3,836,144 9/1974 Mahoney ..... 273/26 A
4,119,311 10/1978 Jenkins et al. ..... 482/27
4,225,131 9/1980 Sidlinger et al. ..... 482/27
5,007,638 4/1991 Yukl ..... 482/28
5,222,731 6/1993 Hanabasa et al. ..... 273/26 A

*Primary Examiner*—Jerome Donnelly
*Attorney, Agent, or Firm*—Bacon & Thomas

[57] ABSTRACT

A multipurpose athletic training apparatus including a trampoline, two stands for holding the trampoline, two fastening devices for fastening the trampoline to the stands, the fastening devices being adjustable to fix the trampoline between a horizontal position in which the trampoline is used as a table, and a tilted position in which the trampoline is used as a rebound apparatus for rebounding balls thrown against it, a handrail for fastening to the stands at the top, and two net posts for fastening to the stands for stretching a net for the game of badminton.

1 Claim, 5 Drawing Sheets

MULTIPURPOSE ATHLETIC TRAINING APPARATUS

BACKGROUND OF THE INVENTION

The present invention relates to a multipurpose athletic training apparatus which can be alternatively arranged into different forms for use as a rebound apparatus for rebounding balls thrown against it, a trampoline for performing acrobatic tumbling and jumping feats, a net post assembly for holding a net for the game of badminton, or an outdoor table for holding things.

A variety of exercising apparatus, including stationary bikes, exe-hikers, abdominal boards, thigh & knee machines, chest developers, etc. have been developed, and have appeared on the market. There are also known various athletic training apparatus designed for athletic training, for example, U.S. Pat. No. 4,650,189, entitled "RECREATIONAL PRACTICE APPARATUS FOR REBOUNDING BALLS": U.S. Pat. No. 4,553,751, entitled "REBOUND APPARATUS"; U.S. Pat. No. 4,456,251, entitled "TENNIS BALL REBOUND PRACTICE NET"; U.S. patent application Ser. No. 08/377,994 filed on Jan. 25, 1995 for "TRAMPOLINE"; U.S. patent application Ser. No. 08/301,391 filed on Sep. 8, 1994 for "MOBILE BACKBOARD FOR BALL GAME PRACTICING". The mobile backboard for ball game practicing of U.S. patent application Ser. No. 08/301,391, which is an invention of the present inventor, comprises an open frame, a cloth bed stretched within the open frame by springs for rebounding balls thrown against it, and a foldaway stand connected to the open frame for supporting the open frame in a sloping position. The trampoline of U.S. patent application Ser. No. 08/377,994, which is another invention of the present inventor, comprises a plurality of legs, an open frame supported on the legs, a jumping bed stretched within the open frame, and an elastic rubber cord hung on the open frame to hold the jumping bed. The aforesaid athletic training apparatus are functional, however they provide only one specific function for a specific purpose.

SUMMARY OF THE INVENTION

It is the major object of the present invention to provide a multipurpose athletic training apparatus which can be alternatively arranged into different forms for use as a rebound apparatus, a trampoline, a net post assembly, or an outdoor table.

According to one aspect of the present invention, the athletic training apparatus includes two stands, a trampoline, two fastening devices for fastening the trampoline to the stands in a tilted position for use as a rebound apparatus for rebounding balls thrown against it, a handrail for fastening to the stands, and two net posts for fastening to the stands for stretching a net for the game of badminton.

According to another aspect of the present invention, the fastening device can be adjusted to change the position of the trampoline from the tilted position to the horizontal position for use as a table for holding things.

DETAILED DESCRIPTION OF THE PREFERRED EMBODIMENT

Figure 1:
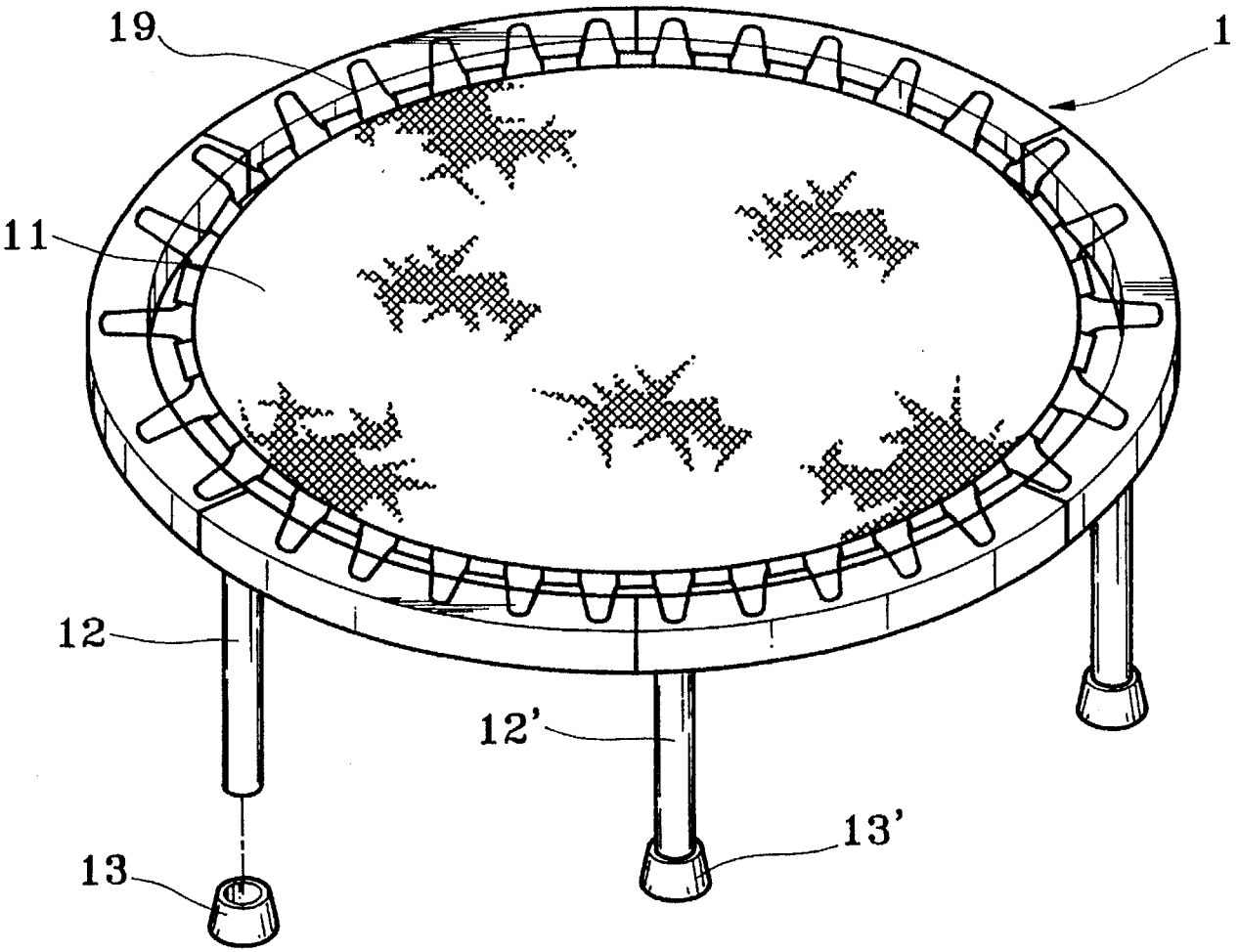
FIG. 1 shows a trampoline according to the present invention.

Referring to FIGS. from 1 to 4, the multipurpose athletic training apparatus of the present invention includes a trampoline 1, two symmetrical stands, namely, the first stand 2 and the second stand 2', a handrail 3, and two net posts 4.

Referring to FIG. 1 again, the trampoline 1 comprises a circular open frame 10, a sheet of strong canvas 11 attached to the circular open frame 10 by springs 19, a plurality of legs 12 and 12' fastened to the circular open frame 10, and foot pads 13 and 13' respectively attached to the legs 12 and 12'. When the trampoline 1 is supported on the floor by the legs 12 and 12' and the foot pads 13 and 13', it is used for performing aerobatic tumbling and jumping feats.

Figure 2:
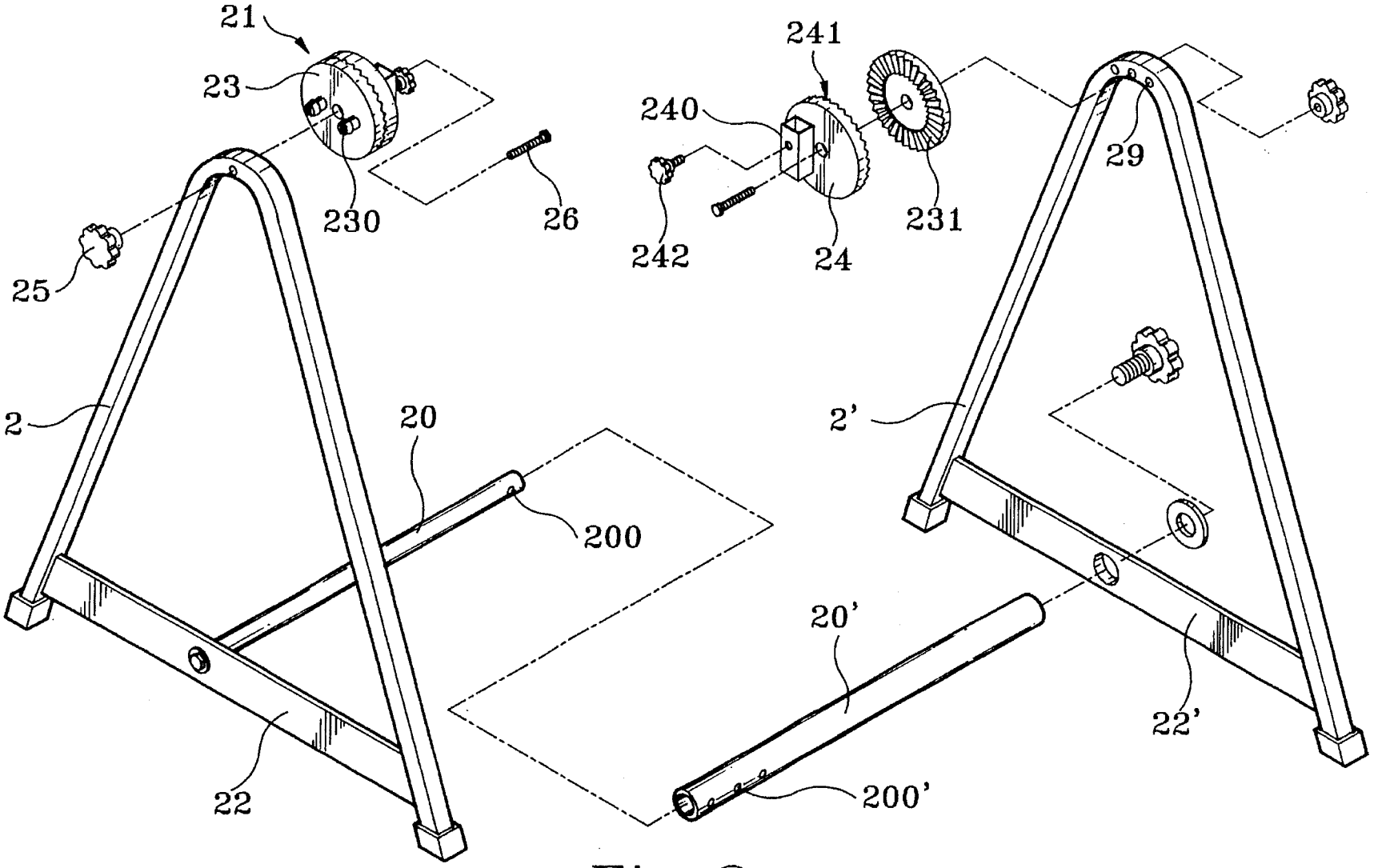
FIG. 2 is an exploded view of a rack according to the present invention.

Referring to FIG. 2 again, the second stand 2' has a cross bottom bar 22' and a connecting tube 20' perpendicularly extended from the cross bottom bar 22' in the middle. The first stand 2 has a cross bottom bar 22 and a connecting tube 20 extended from the cross bottom bar 22 in the middle for insertion into the connecting tube 20'. The connecting tube 20 has a spring-supported steel ball 200 for engaging in one of the longitudinal series of locating holes 200' on the connecting tube 20'. By moving the spring-supported steel ball 200 from one locating hole 200' to another, the combined length of the connecting tubes 20 and 20', i.e., the spacing between the stands 2 and 2' may be adjusted. A fastening device 21 is respectively fastened to the top end of each stand 2, 2'. The fastening device 21 comprises a fixed toothed wheel 23, a movable toothed wheel 24, a cap nut 25, and a screw bolt 2. The fixed toothed wheel 23 has a plurality of split mounting rods 230 at the back side respectively fastened to respective mounting holes 29 on the stand 2 or 2', and radial teeth 231 at the front side for engagement with the movable toothed wheel 24. The movable toothed wheel 24 has radial teeth 241 at the front side for engagement with the radial teeth 231 of the fixed toothed wheel 23, and a socket 240 mounted with a tightening up screw 242. The screw bolt 26 and the cap nut are screwed up to fix the movable toothed wheel 24 and the fixed toothed wheel 23 in position.

Figure 3:
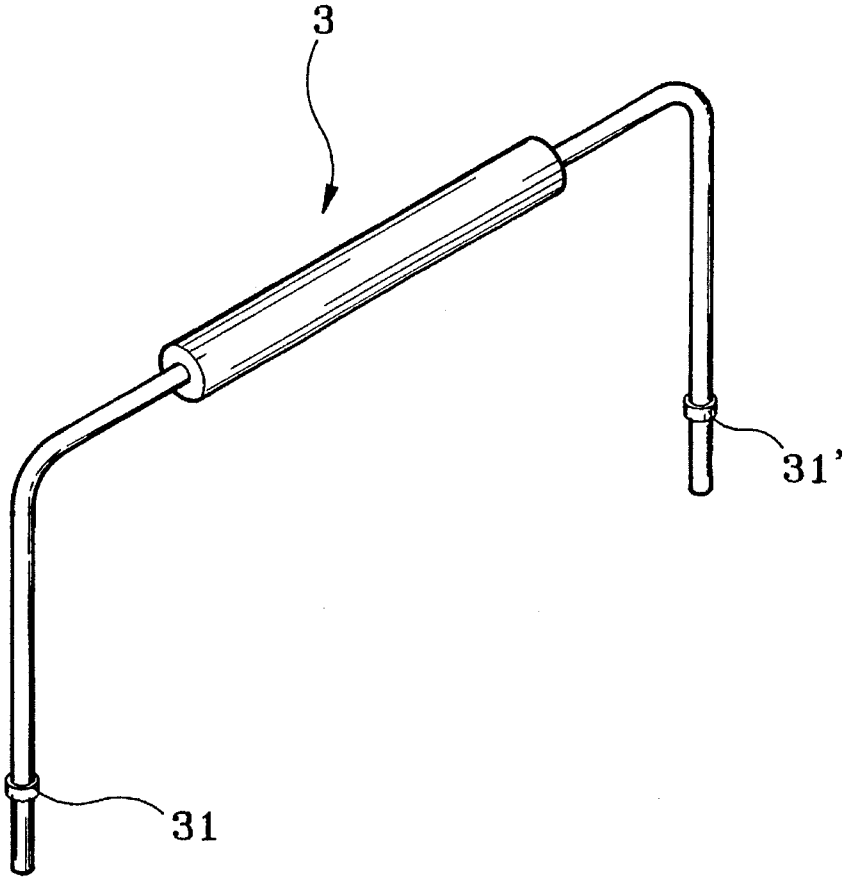
FIG. 3 shows a handrail according to the present invention.

Referring to FIG. 3 again, the handrail 3 is shaped like a U-bar having two collars 31 and 31' near two opposite ends thereof. When the two opposite ends of the handrail 3 are respectively inserted into the axle holders 240 of the fastening devices 21 of the stands 2 and 2', the collars 31 and 31' engage the tops of sockets 240, and the two opposite ends of the handrail 3 are fixed in place by the tightening up screw 242 of each fastening device 21.

Figure 4:
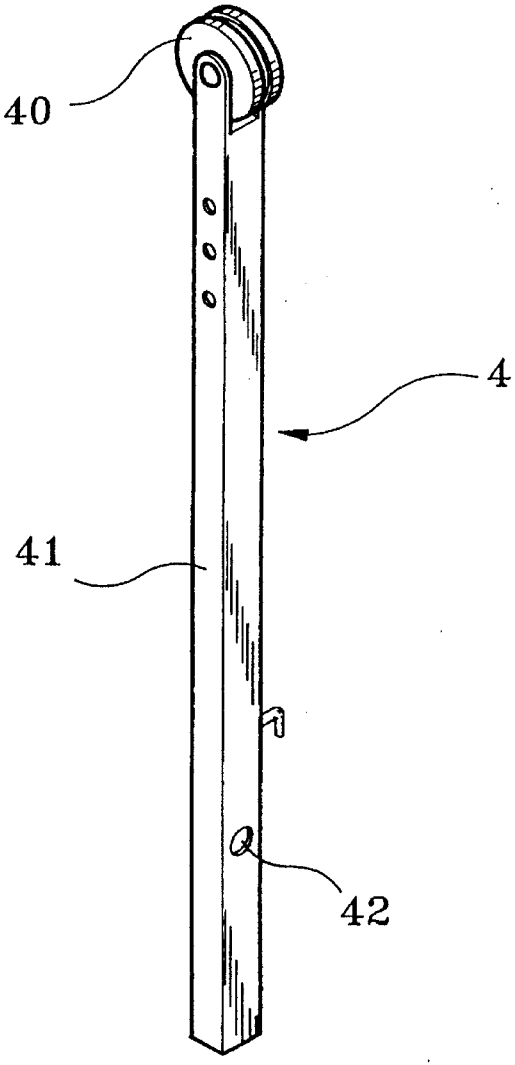
FIG. 4 shows a net post according to the present invention.
Figure 6:
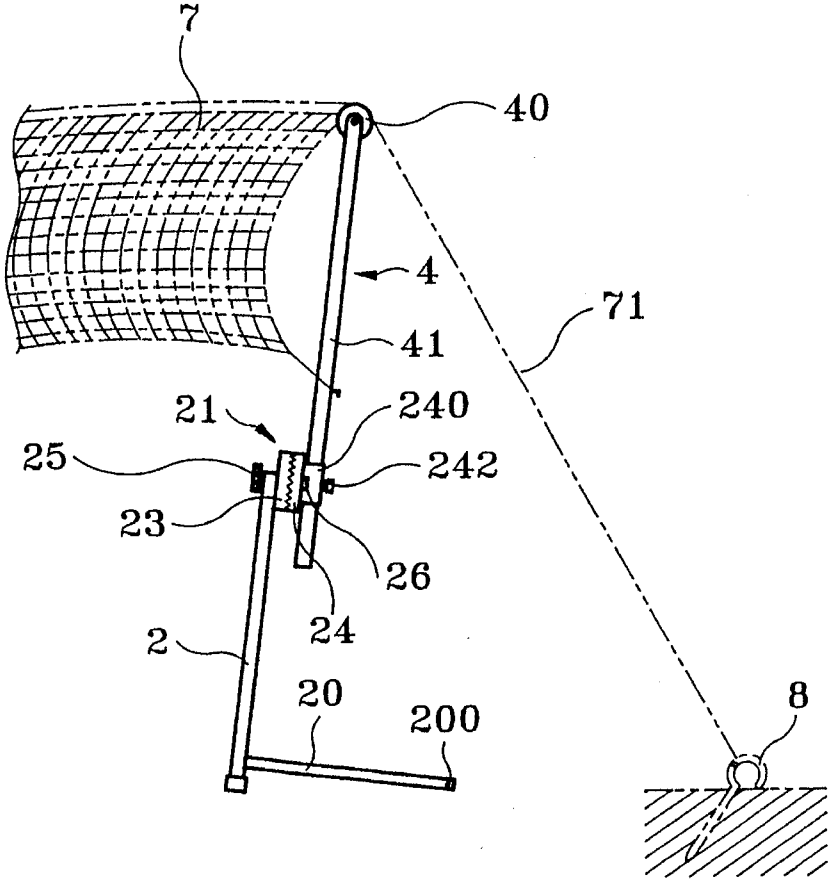
FIG. 6 shows the present invention arranged into the form of a net rack to hold a net for the game of badminton.

Referring to FIG. 6 and FIG. 4 again, the net post 4 comprises an elongated post body 41 for insertion into the socket 240 of one fastening device 23, and a pulley 40 at the top of the post body 41 for mounting the net rope 71 of a net 7. When the post body 41 is inserted into the socket 240 of one fastening device 23, the respective tightening up screw 242 is threaded into a hole 42 on the post body 41 to hold the post body 41 in place, and the net rope 71 is fastened to the ground by an anchoring device 8, to hold the net 7.

Figure 5:
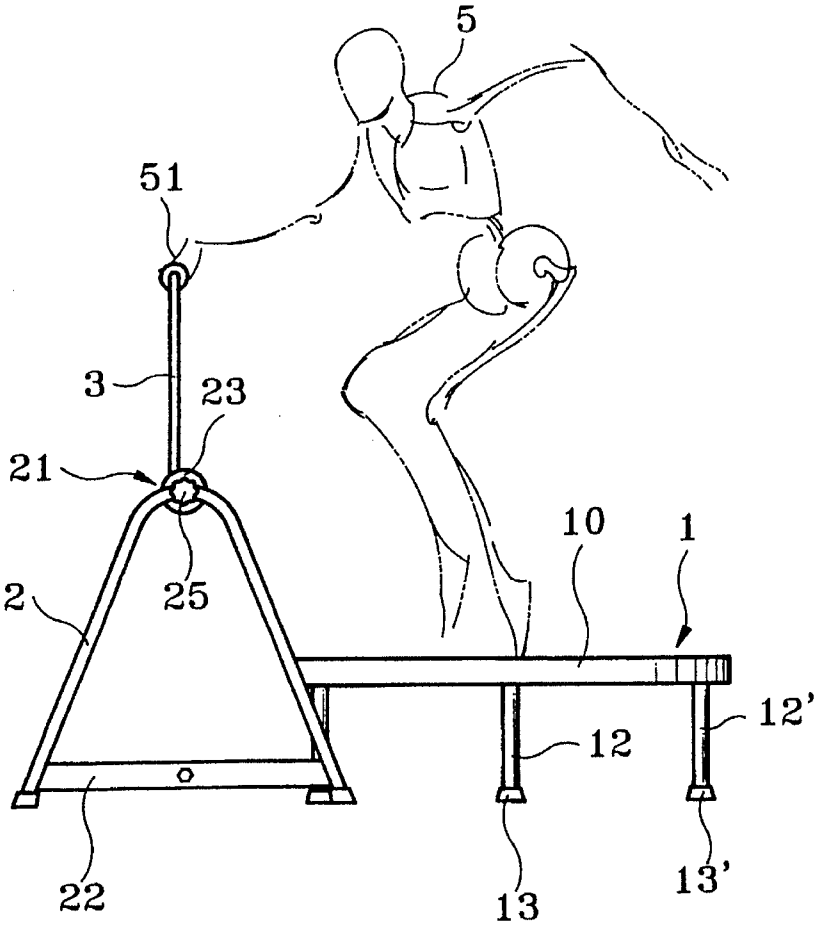
FIG. 5 shows the present invention arranged into an apparatus for performing aerobatic tumbling and jumping feats.

FIG. 5 shows an application example of the present invention, in which the trampoline 1 and the stands 2 and 2' are closely supported on the ground, and the handrail 3 is fastened to the stands 2 and 2' for the holding of the hand 51 of the player 5.

Figure 7:
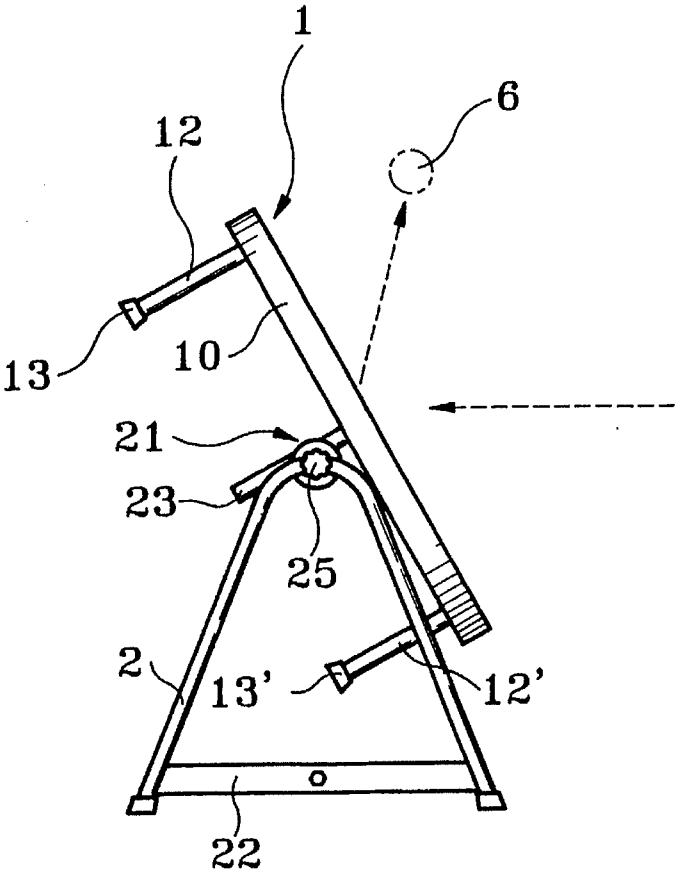
FIG. 7 shows the present invention arranged into the form of a rebound apparatus for rebounding balls thrown against it.

Referring to FIG. 7, the legs 12 of the trampoline 1 can be fastened to the sockets 240 of the fastening devices 21 and retained in a tilted position for use as a rebound apparatus for rebounding bails thrown against it. By loosening the end caps 25, the movable toothed wheels 24 of the fastening devices 21 can be turned relative to the respective fixed toothed wheels 231 to tilt the respective sockets 240.

Figure 8:
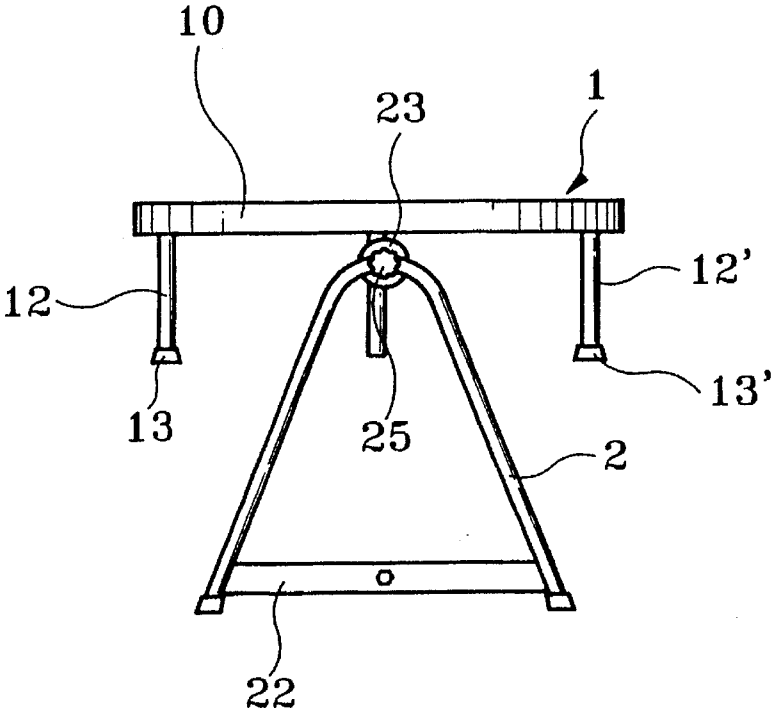
FIG. 8 shows the present invention arranged into the form of an outdoor table for holding things.

Referring to FIG. 8, when the trampoline 1 is fixed to the stands 2 and 2' in horizontal, the trampoline 1 and the stands 2 and 2' form a table for holding things.

I claim:

1. A multipurpose athletic training kit apparatus comprising in combination:

a) a pair of stands;

b) means for detachably securing the stands together at a selected one of plural spacings;

c) a trampoline including a plurality of supporting legs; and d) a fastening device mounted on each stand, each fastening device including a stationary toothed wheel, a movable toothed wheel in detachable engagement with the stationary toothed wheel, a socket mounted to the movable toothed wheel, means for detachably securing one leg of the trampoline in the socket, and means for maintaining the movable toothed wheel in a selected position relative to the stationary toothed wheel to position the socket and the leg at a desired angular disposition, wherein said supporting legs are detachably mounted in respective fastening devices of said stands for permitting the trampoline to be disposed between a horizontal position in which the trampoline is used as a table, and a tilted position in which the trampoline is used as a rebound apparatus for rebounding balls thrown against it.

* * * * *